US005778579A

United States Patent [19]

Yuen

[11] Patent Number: 5,778,579

[45] Date of Patent: Jul. 14, 1998

[54] ILLUMINATED HOUSE NUMBER

[76] Inventor: Shu Wing Yuen, 85 Fieldwood Drive, Scarborough, Ontario, Canada, M1V 3G3

[21] Appl. No.: 670,501

[22] Filed: Jun. 27, 1996

[30] Foreign Application Priority Data

Jun. 27, 1995 [CA] Canada ..... 2,152,715

[51] Int. Cl.[6] ..... G09F 13/04

[52] U.S. Cl. ..... 40/564; 40/544; 40/576; 40/581; 362/800; 362/812; 439/928; 439/929

[58] Field of Search ..... 40/544, 564, 570, 40/573, 576, 581; 362/219, 800, 812; 439/374, 660, 928, 929

[56] References Cited

U.S. PATENT DOCUMENTS

| | | | |
|---|---|---|---|
| 1,098,842 | 6/1914 | Savage | 40/576 |
| 1,782,564 | 11/1930 | Coufal et al. | 362/812 X |
| 1,844,097 | 2/1932 | Luhman | 40/573 |
| 2,637,926 | 5/1953 | Anderson | 362/812 X |
| 2,774,609 | 12/1956 | Winger | 403/381 X |
| 4,271,408 | 6/1981 | Teshima et al. | 40/564 X |
| 4,532,579 | 7/1985 | Merryman | 40/576 X |
| 4,564,732 | 1/1986 | Lancaster et al. | 403/381 X |
| 4,745,534 | 5/1988 | Brunner | 362/800 X |
| 4,754,380 | 6/1988 | Wang | 362/812 X |
| 5,020,253 | 6/1991 | Lie et al. | 40/576 |
| 5,365,411 | 11/1994 | Rycroft et al. | 40/570 X |
| 5,431,570 | 7/1995 | Gibbs et al. | 439/929 X |

FOREIGN PATENT DOCUMENTS

| | | | |
|---|---|---|---|
| 2006513 | 6/1990 | Canada . | |
| 31609 | 12/1933 | Netherlands | 40/573 |
| 938483 | 10/1963 | United Kingdom | 40/564 |

*Primary Examiner*—Kenneth J. Dorner
*Assistant Examiner*—Andrea Chop
*Attorney, Agent, or Firm*—Marks & Clerk

[57] ABSTRACT

An interlocking display panel assembly comprises a pair of end elements for attachment to a supporting surface, at least one intermediate element having an indicia displaying surface locatable in an interlocking relationship between the end elements to form an integral planar assembly, illumination devices in the intermediate elements. Each element interlocks with an adjacent element by means of a tongue-and-groove arrangement, male and female portions of the tongue-and-groove arrangements on opposite sides of the intermediate elements being arranged in a complementary manner so that as many intermediate elements can be fitted together in a row as desired. Respective contacts are provided on opposing surfaces of adjacent interlocking elements so as to transfer electrical power between adjacent elements. One of the end elements includes a device for providing power to the assembly.

9 Claims, 3 Drawing Sheets

ILLUMINATED HOUSE NUMBER

BACKGROUND OF THE INVENTION

This invention relates to an interlocking display panel assembly, for example for displaying indicia such as street numbers on domestic residences.

One such display panel assembly is described in U.S. Pat. No. 5,020,253. While this panel assembly represents an improvement over the prior art, the assembly, especially if there are more than two numbers, can easily fall apart prior to installation because of the manner in which the panels are interconnected. Also, there is lack of uniformity of illumination of these display panels.

An object of the present invention is to alleviate the aforementioned problems.

SUMMARY OF THE INVENTION

According to the present invention there is provided an interlocking display panel assembly comprising a pair of end elements for attachment to a supporting surface, at least one intermediate element having an indicia displaying surface locatable in an interlocking relationship between said end elements to form an integral planar assembly, illumination means in said intermediate elements for illuminating said indicia, each said element interlocking with an adjacent said element by means of a tongue-and-groove arrangement, male and female portions of said tongue-and-groove arrangements on opposite sides of said intermediate elements being arranged in a complementary manner so that as many intermediate elements can be fitted together in a row as desired, respective contact means provided on opposing surfaces of adjacent interlocking elements so as to transfer electrical power between adjacent elements, and one of said end elements including means for providing power to the assembly.

Preferably said tongue-and-groove arrangement extends along an axis normal to the plane of the assembly and is tapered along this axis to block further insertion when the intermediate elements are properly aligned.

Furthermore, said illumination means are preferably in the form of rectangular block LED's (light emitting diodes).

The described assembly can be conveniently prepared by choosing the intermediate elements displaying the appropriate indicia, for example house numbers and then interfitting the adjacent elements using the tongue-and-groove arrangements. The complete assembly is robust and can be treated as an integral component that can be conveniently attached to a wall, for example by screws.

BRIEF DESCRIPTION OF THE DRAWINGS

The present invention will now be described in more detail, by way of example only, with reference to the accompanying drawings, in which.

DESCRIPTION OF THE PREFERRED EMBODIMENTS

Figure 1:
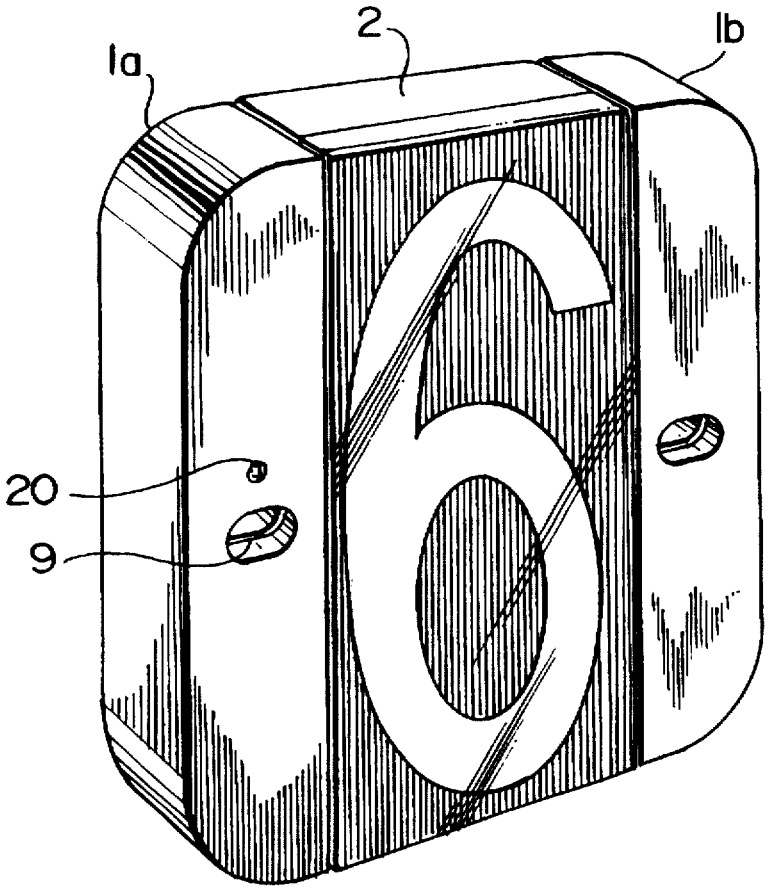
FIG. 1 is a front perspective view of a panel assembly having a single intermediate element.

In FIG. 1, the panel assembly comprises two end elements 1*a*, 1*b*, and an intermediate element 2, which is interlocked between the end elements 1*a*, 1*b*. Although only one intermediate element is shown in FIG. 1, it will become apparent that as many intermediate elements can be interfitted as are needed to display the required number. In FIG. 1, the number 6 is displayed. For example, to display the number 605, additional intermediate elements displaying the numbers 0 and 5 would be added to the right of the element shown displaying the number 6, and between it and the end element 1*b*.

Figure 2:
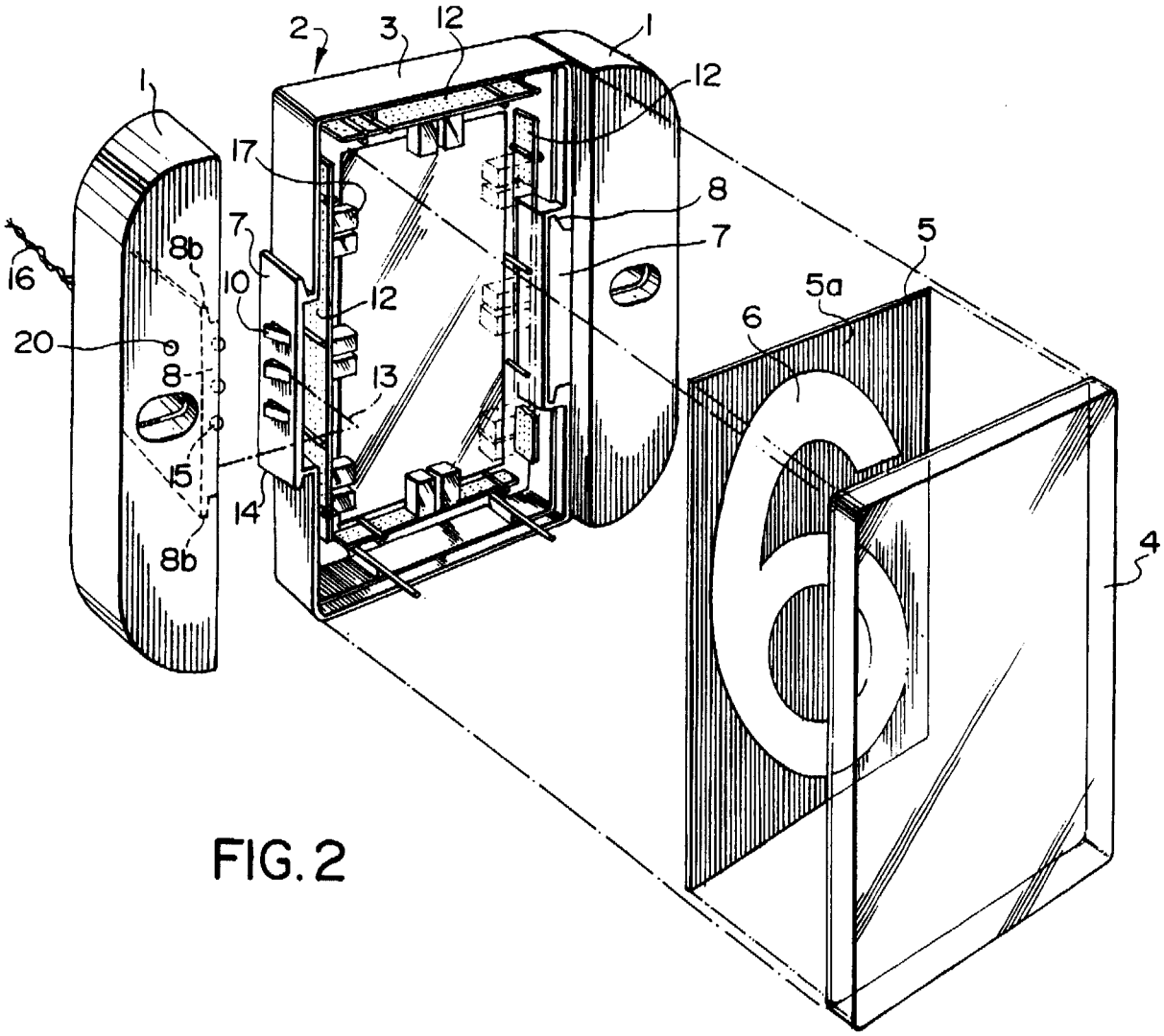
FIG. 2 is an exploded view of the intermediate element shown in FIG. 1.

As shown in FIG. 2, each intermediate element 2 comprises a rectangular hollow box 3 with a transparent front panel 4 behind which is located a plastic sheet 5 approximately 1.5 mm thick with an opaque portion 5*a* and a translucent portion 6 forming the number to be displayed. The opaque portion 5*a* is silk-screened onto the translucent sheet 5 leaving only the translucent portion 6 outlining the number to be displayed.

Behind the sheet 5 is located an array of commercially available cubic LED's 17. When arranged around the periphery of the box these cubic LED's provide a particularly effective and uniform form of illumination for the number to be displayed. The LED's 17 are connected to driver circuitry mounted on printed circuit boards 12. One feature of the invention is that the LED's 17 are arranged in pairs of different colors. Either color can be selectively energized allowing the user a choice of color for the background illumination.

Another feature of the invention is that the intermediate elements 2 and the end elements 1*a*, 1*b* are mutually interlocked by means of a tongue-and-groove arrangements 7, 8. One side of the box 3 contains a tongue 7 and the other a complementary groove 8 so that the boxes may be fitted together in a row in any order, each box 3 being sequentially attached to the next. One end element 1*a* has a groove 8, and the other 1*b* a tongue 7 in a manner consistent with this scheme so that the end elements can be located at the end of the array.

Each tongue-and-groove arrangement 7, 8 is arranged with its axis normal to the plane of the assembly so that an end element can be interlocked with an intermediate element, or intermediate elements can be interlocked with each other simply by sliding them together along the axis 13 normal to the plane of the assembly. This means that the elements are robustly interlocked against a lateral pull and will remain held together until the assembly is screwed onto a wall by means of screws inserted through holes 9 in the end elements 1*a*, 1*b*.

Furthermore the tongue-and-groove arrangements 7, 8 have a taper 14 so that the degree of insertion is limited. When the elements are fully inserted, the elements are properly aligned in a plane.

Another important aspect of the invention is the fact that contacts 10, 15 are provided on the opposing surfaces of the interlocking tongue-and-groove arrangements. Respective opposing contacts make an electrical contact with each other when the tongue-and-groove arrangements are fitted together. In this manner, electrical power is carried from one end element 1*a* through to the interlocking intermediate element 2, and from that element through to the adjacent interlocking element and so on.

The element 1*a* is provided with means to supply electric power to the system. This could be a battery mounted in the end element, or preferably simply a wire 16 for connection to the public supply.

This element 1*a* also includes a photosensor 20 employing a Clairex™ photoelectric cell that activates the LEDS 7 when the ambient light level falls below a predetermined value. The photosensor 20 does not turn on the LEDs 7 suddenly but rather gradually increases their brilliance as the ambient light level falls and vice versa.

Figure 3:
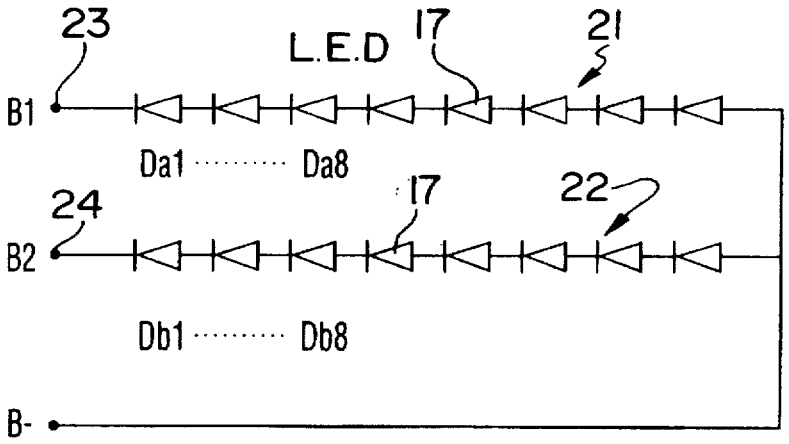
FIG. 3 shows the LED arrays.

The arrangement of LEDs is shown in FIG. 3. The LEDs 7 are arranged in two parallel chains 21, 22 connect to switch contacts 23, 24. Photosensor 20 controls thyristor 26 through transistor 25.

In operation the user selects the chain of LEDs 21, 22, for example red or green according to preference. As the light level falls, the thyristor 26 turns on and gradually increasing amounts of power are supplied to the LED chain 21 or 22.

Figure 4:
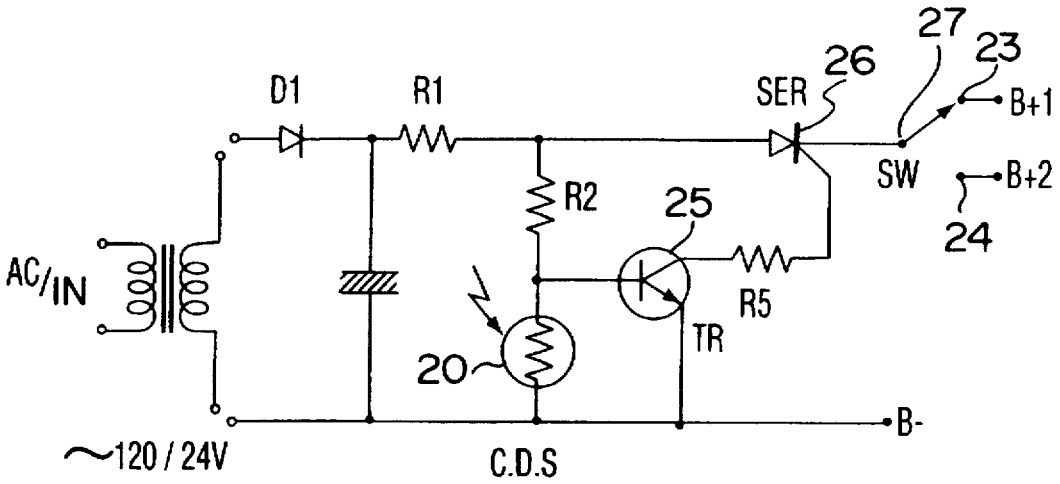
FIG. 4 is a circuit diagram.

A schematic of the circuit is shown in FIG. 4.

As will be seen, the described panel assembly is particularly easy to assembly and install. The interlocking tongue-and-groove arrangement ensures a robust fit and continuity of the power supply from one element to the next in a particularly effective and simply manner.

I claim:

1. An interlocking display panel assembly comprises a pair of end elements for attachment to a supporting surface, at least one intermediate element having an indicia displaying surface locatable in an interlocking relationship between said end elements to form an integral planar assembly, illumination means in said at least one intermediate element for illuminating said indicia displaying surface, each said element slidably engaging an adjacent said element by means of a tongue-and-groove arrangement having a dovetail tongue interlocking with a complementary groove to lock adjacent said elements against relative lateral displacement, male and female portions of said tongue-and-groove arrangements on opposite sides of said intermediate element being arranged in a complementary manner so that as many intermediate elements can be fitted together in a row as desired, respective contact means provided on opposing surfaces of adjacent interlocking elements so as to come into abutting contact when said male and female portions are fitted together and thereby transfer electrical power between adjacent elements, and one of said end elements including means for providing power to the assembly, and wherein said tongue-and-groove arrangements are tapered along an axis along which they are slid together to permit insertion from only one direction and to inhibit further insertion when all the elements are properly aligned.

2. An interlocking display panel assembly as claimed in claim 1, wherein said tongue-and-groove arrangements extend along an axis normal to the plane of the assembly so that adjacent said elements can be fitted together by sliding them along said axis.

3. An interlocking display panel assembly as claimed in claim 1, wherein said illumination means are in the form of light emitting diodes.

4. An interlocking display panel assembly as claimed in claim 3, wherein said at least one intermediate element is in the form of a rectangular box.

5. An interlocking display panel assembly as claimed in claim 4, wherein said light emitting diodes are arranged around the internal perimeter of said rectangular box.

6. An interlocking display assembly as claimed in claim 3, wherein said light emitting diodes are arranged in groups, each member of the group having a different color, the light emitting diodes of each color being independently energizeable so as so as to give the user a choice of background color.

7. An interlocking display panel assembly as claimed in claim 6, wherein said light emitting diodes are cubic light emitting diodes.

8. An interlocking display panel assembly as claimed in claim 1, further comprising a photosensor for progressively switching on said illumination means in accordance with the ambient light level.

9. An interlocking display panel assembly as claimed in claim 1, wherein said indicia displaying surface comprises a translucent sheet having an opaque background silk-screened thereon to an outline of said indicia.

* * * * *